US007646278B2

(12) United States Patent
Yang et al.

(10) Patent No.: US 7,646,278 B2
(45) Date of Patent: Jan. 12, 2010

(54) HIGH VOLTAGE TRANSFORMER WITH HIGH MAGNETIC LEAKAGE AND DUAL HIGH VOLTAGE OUTPUT

(75) Inventors: Ching-Sheng Yang, Taipei (TW); Su-Hua Wu, Panchiao (TW); Shu-Chen Wang, Chung-Ho (TW)

(73) Assignee: Taipei Multipower Electronics Co., Ltd., Hsin-Tien, Taipei Hsien (TW)

( * ) Notice: Subject to any disclaimer, the term of this patent is extended or adjusted under 35 U.S.C. 154(b) by 4 days.

(21) Appl. No.: 12/200,907

(22) Filed: Aug. 28, 2008

(65) Prior Publication Data

US 2008/0315981 A1 Dec. 25, 2008

Related U.S. Application Data

(63) Continuation-in-part of application No. 10/905,088, filed on Dec. 15, 2004, now abandoned.

(51) Int. Cl.
*H01F 27/02* (2006.01)

(52) U.S. Cl. ..... 336/90

(58) Field of Classification Search ..... 336/65, 336/90, 192, 198, 200, 212, 232, 170, 220–223, 336/180–184

See application file for complete search history.

(56) References Cited

U.S. PATENT DOCUMENTS 6,734,777 B2 * 5/2004 Yeh et al. ..... 336/208
7,301,430 B1 * 11/2007 Chan et al. ..... 336/200
7,446,641 B2 * 11/2008 Fushimi ..... 336/212
7,449,986 B2 * 11/2008 Yamaguchi et al. ..... 336/192
7,528,694 B2 * 5/2009 Tseng et al. ..... 336/212
2006/0181384 A1 * 8/2006 Hsueh et al. ..... 336/122
2008/0024262 A1 * 1/2008 Chang et al. ..... 336/208
2008/0297296 A1 * 12/2008 Teng et al. ..... 336/98

* cited by examiner

*Primary Examiner*—Tuyen Nguyen

(57) ABSTRACT

The present invention relates to a high voltage transformer with high magnetic leakage and dual high voltage output, comprising a base and a core set, wherein the base contains a hollow support into which a first core of the core set pierces, and primary coils are wound on both sides of the hollow support, while a plurality of isolation channels is installed for winding first and second secondary coils on external sides of primary coils. First and second slots are opened between the primary coils and the first and second secondary coils respectively, and both slots cut into an internal through hole. When a second core of the core set is placed at one end of the hollow support, extensions at both ends of the second core go through both sides of the first core, together with first and second protrusive parts between the two extensions that are installed within the first and second slots and combined with the first core to form multiple magnetic paths.

6 Claims, 8 Drawing Sheets

HIGH VOLTAGE TRANSFORMER WITH HIGH MAGNETIC LEAKAGE AND DUAL HIGH VOLTAGE OUTPUT

This application is a Continuation-In-Part of my patent application Ser. No. 10/905,088, filed on Dec. 15, 2004.

BACKGROUND OF THE INVENTION

1. Field of the Invention

The present invention provides a high voltage transformer with high magnetic leakage and dual high voltage output, particularly, a high voltage transformer that can mitigate coupling effect between primary and secondary coils to enhance leakage inductance through design of dual bypass flux, and can enlarge the creepage distance between primary and secondary coils through the design of isolation plates on the protection cover, for the purpose of providing dual high voltage output.

2. Description of Related Art

Refer to FIGS. 7 and 8, which show the breakdown structure and appearance of a high voltage transformer in conventional use. As shown clearly in these figures, the high voltage transformer for conventional use contains a support A, within which there is a jack A1. A first core B1 of a core set B pierces through the jack A1, and a primary coil A2 and a secondary coil A3 wind around the surface of the support. A plurality of conducting terminals A4 is placed at both ends of the support A to connect the primary coil A2 with the secondary coil A3 electrically, and a the second core B2 is placed on one side of the support A. Extensions B21 reach out from the two ends of the second core B2 and approach two sides of the first core B1 to form a magnetic path. When the high voltage transformer is used, the power supply and a lamp (not indicated in the figures) are connected to the conducting terminals A4 at both ends of the support A respectively, so that the power will be transmitted to the lamp via the primary coil A2 and the secondary coil A3.

For the above-mentioned high voltage transformer of conventional use, a magnetic path is utilized to generate induction from the primary coil A2 and secondary coil A3 so as to change the voltage. However, because the primary coil A2 and the secondary coil A3 share a magnetic path, there is no any bypass available for magnetic flows from primary coils to secondary coils, and the coupling effect is excellent. With low leakage inductance, this circuit cannot meet the requirement of resonance circuits partly.

Thus, how to solve the common problems and disadvantages as mentioned above is just what the firms involved in this industry need urgently to research and improve.

SUMMARY OF THE INVENTION

The primary purpose of the present invention is to enable the first core of the core set to pierce into the hollow support of the base and install isolation plates at the center of the hollow support. There are primary coils and a plurality of isolation channels for winding the first and second secondary coils placed on either side of the isolation plate at the center of the hollow support in orderly way. The first and second slots are opened between primary coils and the first and second secondary coils respectively, and cut into an internal through hole, while isolation plates are installed between adjacent slots to widen the coil winding creepage distance. When the second core of the core set is placed at one side edge of the hollow support, extensions at both ends of the second core go through both sides of the first core, together with the first and second protrusive parts between the two extensions that are installed within the first and second slots and combined with the first core to form multiple magnetic paths. Then the magnetic path, formed by magnetic flux of the primary coils flowing from the first and second protrusive parts to the first core, is considered as a bypass to generate magnetic leakage, thus mitigating the coupling effect between primary coils and secondary coils and enhancing leakage inductance.

The secondary purpose of the present invention is to further cover the base with a protection cover, inside which the first and second isolation plates are installed to separate the first and second secondary coils from the first and second protrusive parts so as to separate the two protrusive parts from the two secondary coils. This can prevent high voltage puncture from occurring because of close proximity of two protrusive parts of the second core to the two secondary coils. Enlargement of the creepage distance for coil winding can establish a safe distance, thus avoiding sparking phenomena (short-circuits) that may occur due to unsafe distance from the two protrusive parts of the second core to the two secondary coils, thus raising the operational efficiency of the transformer and extending its service life.

DETAILED DESCRIPTION OF THE INVENTION

The preferred embodiments of the present invention are illustrated in detail by the examples and accompanying drawings given below in order for members of the review committee to further understand the objectives, appearance, configuration, devices, features and functions of the present invention.

Figure 1:
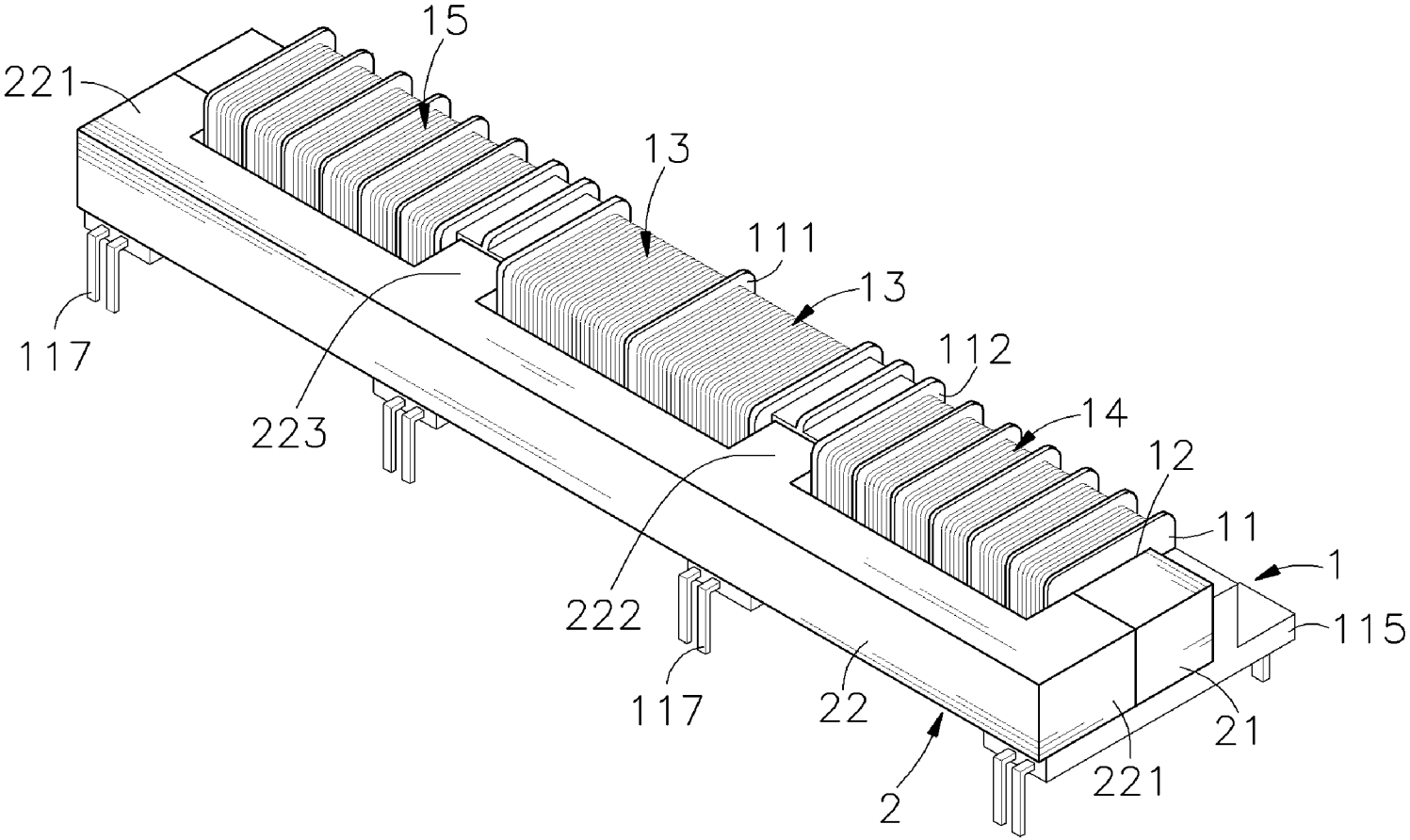
FIG. 1 is a three-dimensional appearance drawing according to one preferred embodiment of the present invention.
Figure 2:
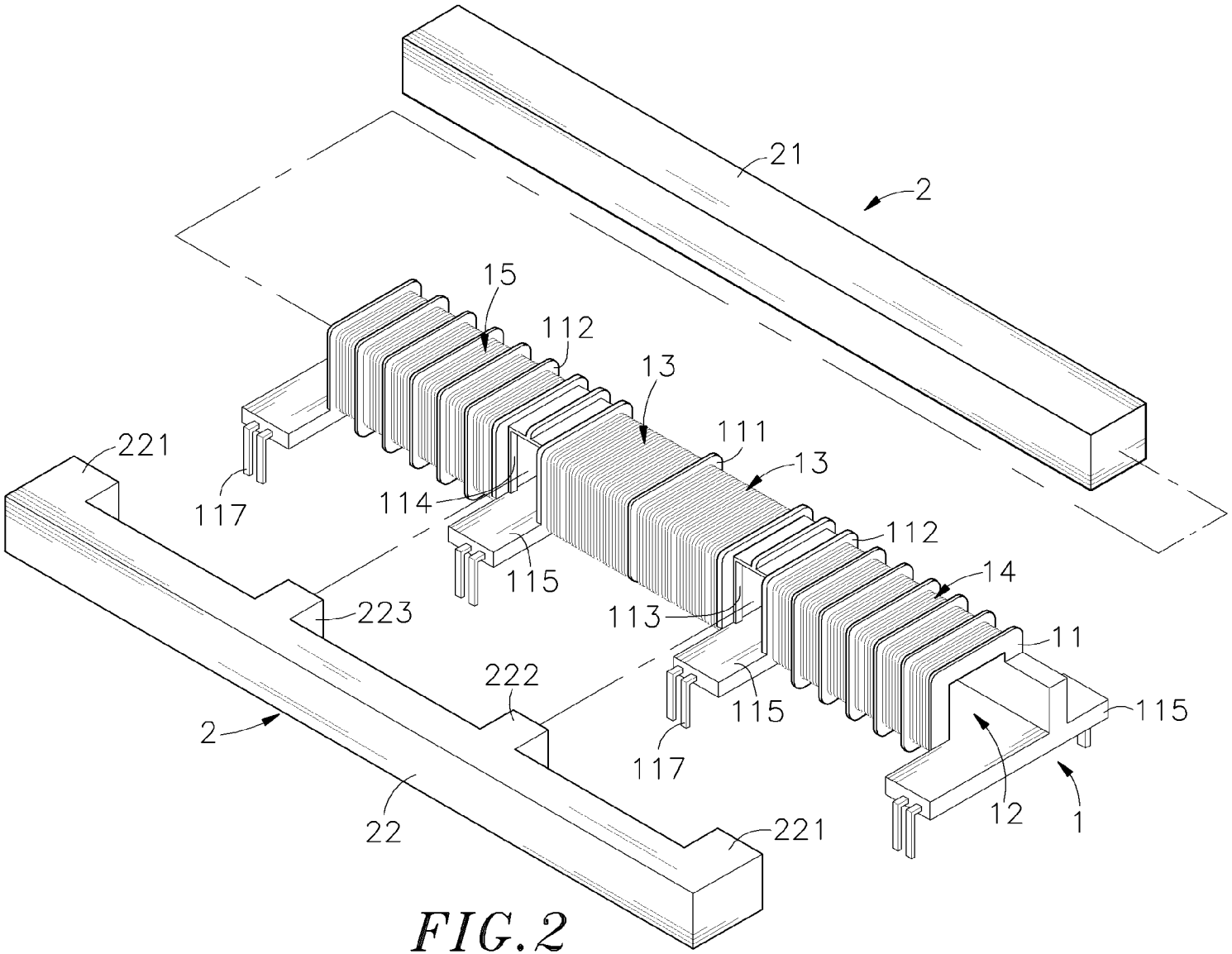
FIG. 2 is a three-dimensional breakdown drawing according to one preferred embodiment of the present invention.
Figure 3:
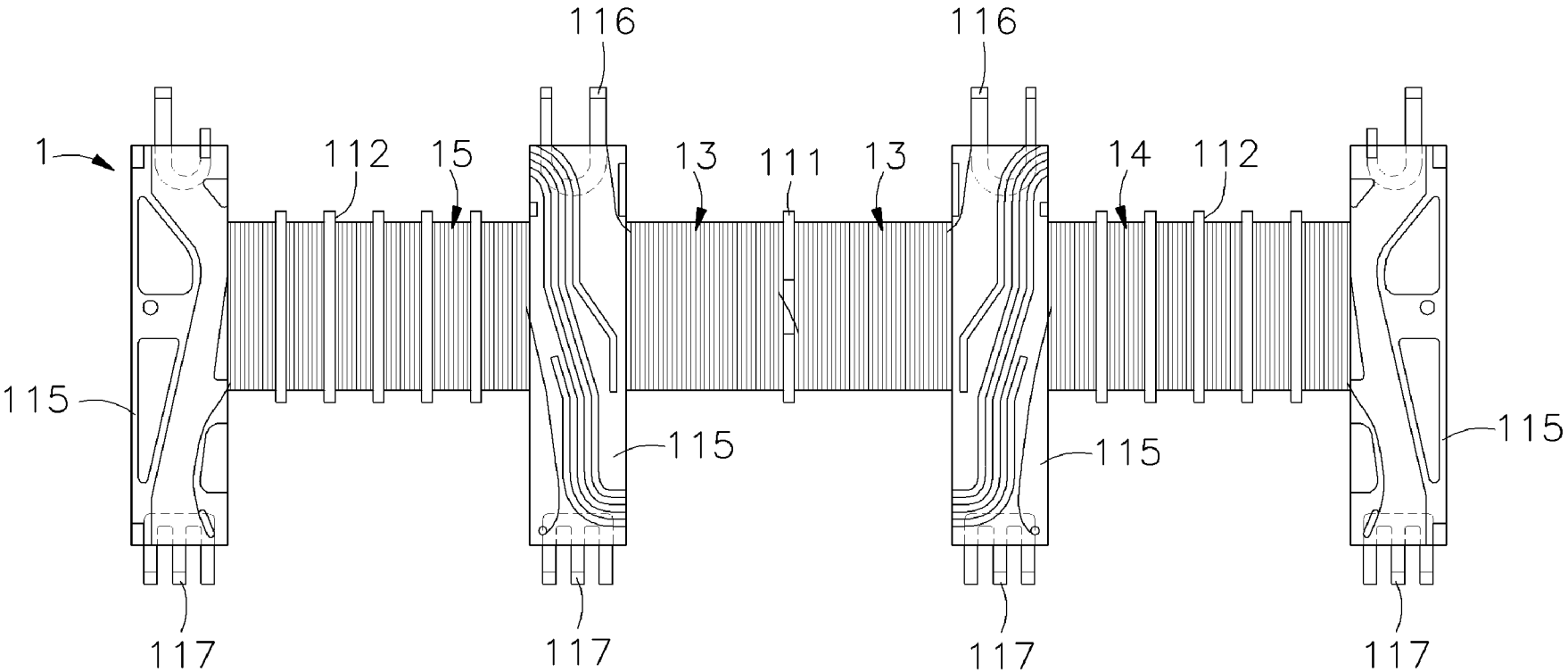
FIG. 3 is an upward view drawing according to one preferred embodiment of the present invention.

Refer to FIGS. 1, 2 and 3, which are the 3D appearance drawing, 3D breakdown drawing and upward view drawing of the present invention respectively. These figures show that the high voltage transformer with high magnetic leakage and dual high voltage output of the present invention comprises a base 1 and a core set 2 (in this example, the main components and features will be described in detail as follows), wherein:

The base 1 contains a hollow support 11 around which coils can be wound, and there is a through hole for the core set 2 to pierce inside the hollow support 11. A central isolation plate 111 is placed roughly at the center on the surface of the hollow support 11. On one side of the central isolation plate 111, a primary coil 13 is wound and a plurality of isolation channels 112 for winding and crossover of a first secondary coil 14 is established to the outward side of the primary coil 13. On another side of the central isolation plate 111, there is the primary coil 13 wound, and to the outward side of the primary coil 13, there is the plurality of isolation channels 112 for winding and crossover of a the second secondary coil 15. The first slot 113 is opened on the hollow support 11 between the primary coil 13 and the first secondary coil 14, and cuts into an internal through hole 12, while a the second slot 114 is opened on the hollow support 11 between the primary coil 13 and the second secondary coil 15. An isolation plate 115 is installed between the first secondary coil 14 and the second secondary coil 15 to enlarge the creepage distance for coil winding, and an input terminal 116 is installed at one end of the hollow support 11 to connect the primary coils 13, while an output terminal 117 is placed at the other end that is far away from the input terminal 116 to connect the first secondary coil 14 and the second secondary coil 15.

The core set 2 includes a first core 21 that pierces through the internal through hole 12 and a second core 22 placed on one side of the hollow support 11 respectively, wherein two extensions 221 protrude from both ends of the second core 22. The two extensions 221 from the second core 22 are protruded and assembled with the first slot 113 and the second slot 114 as well as the first core 21 to form a first protrusive part 222 and a second protrusive part 223 of multiple magnetic paths.

To install the components as indicated above, at first the primary coils 13 are wound around the two sides of the central isolation plate 111 of the hollow support 11 on the base 1, and the first secondary coil 14 and the second secondary coil 15 are wound around the isolation channel 112 on the outward side of the primary coils 13, which are wound and connected to the isolation plate 115 at the bottom, and further linked with the input terminal 116. Then the two secondary coils 14 and 15 are wound around the multiple isolation channels 112 and further connected with the isolation plates at both ends, and the wires extending from the two secondary coils 14 and 15 are connected to the two output terminals 117, so that the isolation plate 115 can be used to wind the primary coils 13 and the two secondary coils 14 and 15 for widening the creepage distance between these coils. Thus the first core 21 of the core set 2 can be inserted into the internal through hole 12 installed within the hollow support 11, with both ends of the first core 21 protruding from the internal through hole 12. Next, the second core 22 is placed on one side of the hollow support 11, and the extensions 221 from the both ends of the second core 22 are placed on two sides of the first core 21 respectively, making the first protrusive part 222 and the second protrusive part 223 of the second core 22 combined correspondingly with the first core inside the first slot 113 and the second slot 114 of the hollow support 11, so that the primary coils 13 can be connected with the two secondary coils 14 and 15 on left and right sides of the central isolation plate 111 respectively to form multiple magnetic paths with the first core 21 and the second core 22. By doing so, configuration of a high voltage transformer of the present invention will be completed.

Figure 4:
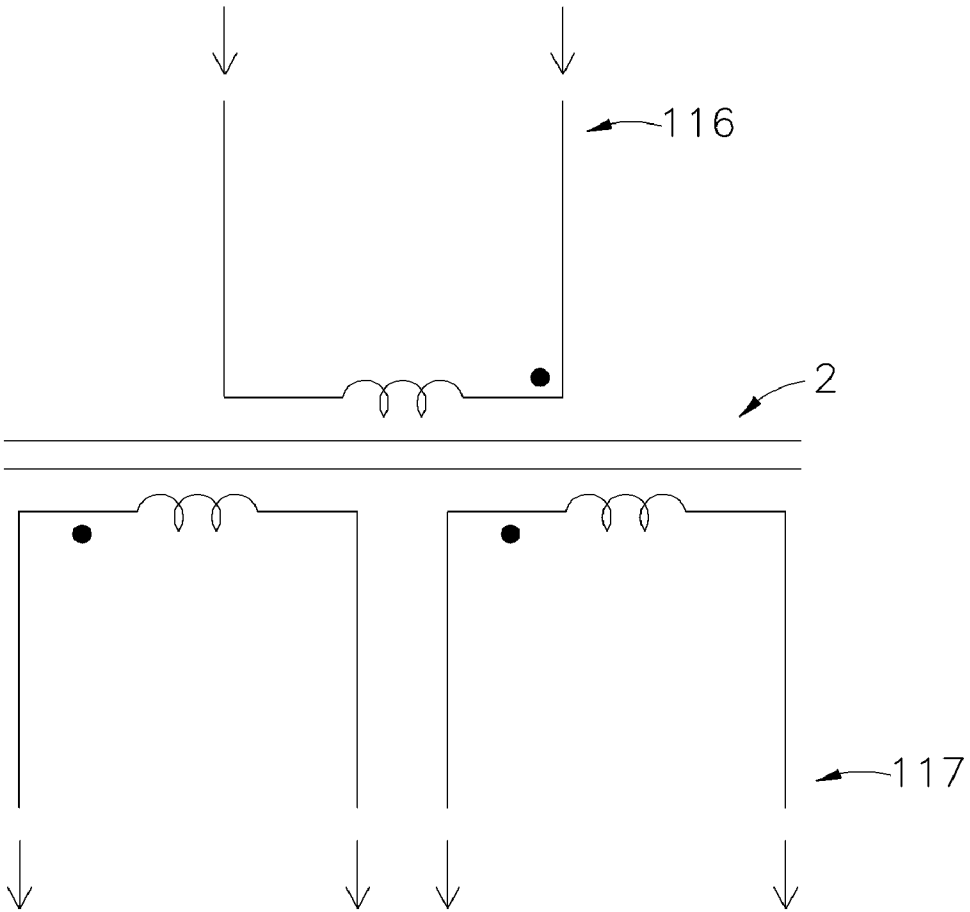
FIG. 4 is a simple circuit diagram according to one preferred embodiment of the present invention.

Refer to FIGS. 1, 3 and 4. Following completion of the configuration as indicated above, when the high voltage transformer of present invention is used, the primary coils 13 are wound and connected with the isolation plate 115 at the bottom and be further connected to the input terminal 116, which is coupled with an external driving circuit that is pre-installed, so that the driving circuit can provide power input to the primary coils 13. Then the two secondary coils 14 and 15 wound on the outward side of the primary coils 13 will generate induced flux respectively, and the inducted voltage will be generated via the turns ratio between the primary coils 13 and the two secondary coils 14 and 15 and outputted via the output terminal 117 connected with the two secondary coils 14 and 15 to achieve the purpose of changing the voltage. With design of the first protrusive part 222 and the second protrusive part 223 of the second core 22, the magnetic flux of the primary coils 13 will lead to magnetic leakage due to existence of the magnetic paths between the first protrusive part 222 and the second protrusive part 223 and the first core 21 as bypass circuits, which will reduce the coupling effect between the primary coils 13 and the two secondary coils 14 and 15 and enhance leakage inductance, thus allowing the high voltage transformer to meet the requirement for resonance. In addition, the magnetic path formed by the core set 2 and two sets of corresponding coils on both sides of the base 1 can drive over two lamps connected to the two secondary coils 14 and 15. In this way, a transformer can be used to drive many lamps.

Figure 5:
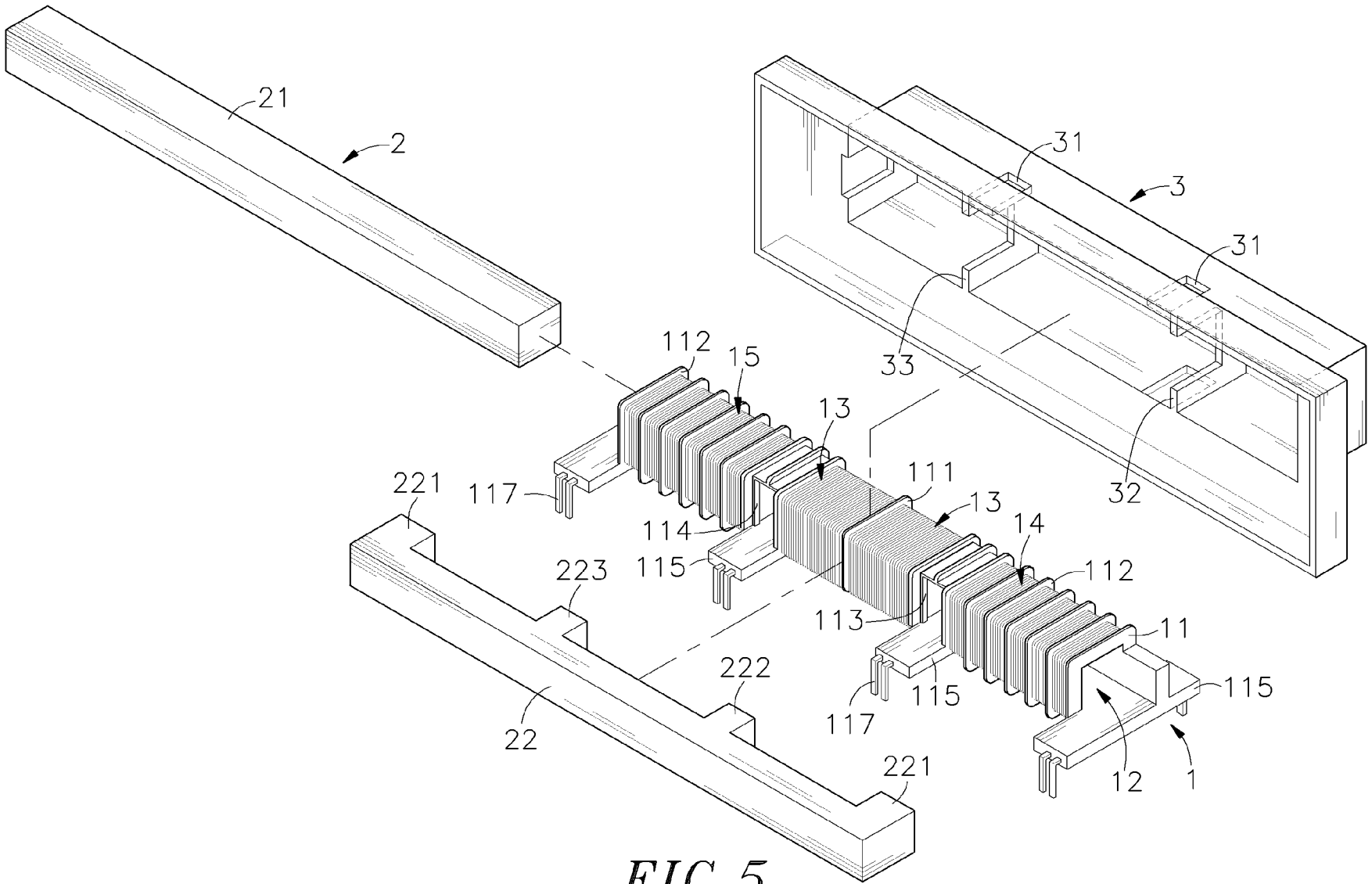
FIG. 5 is a three-dimensional breakdown drawing according to another preferred embodiment of the present invention.
Figure 6:
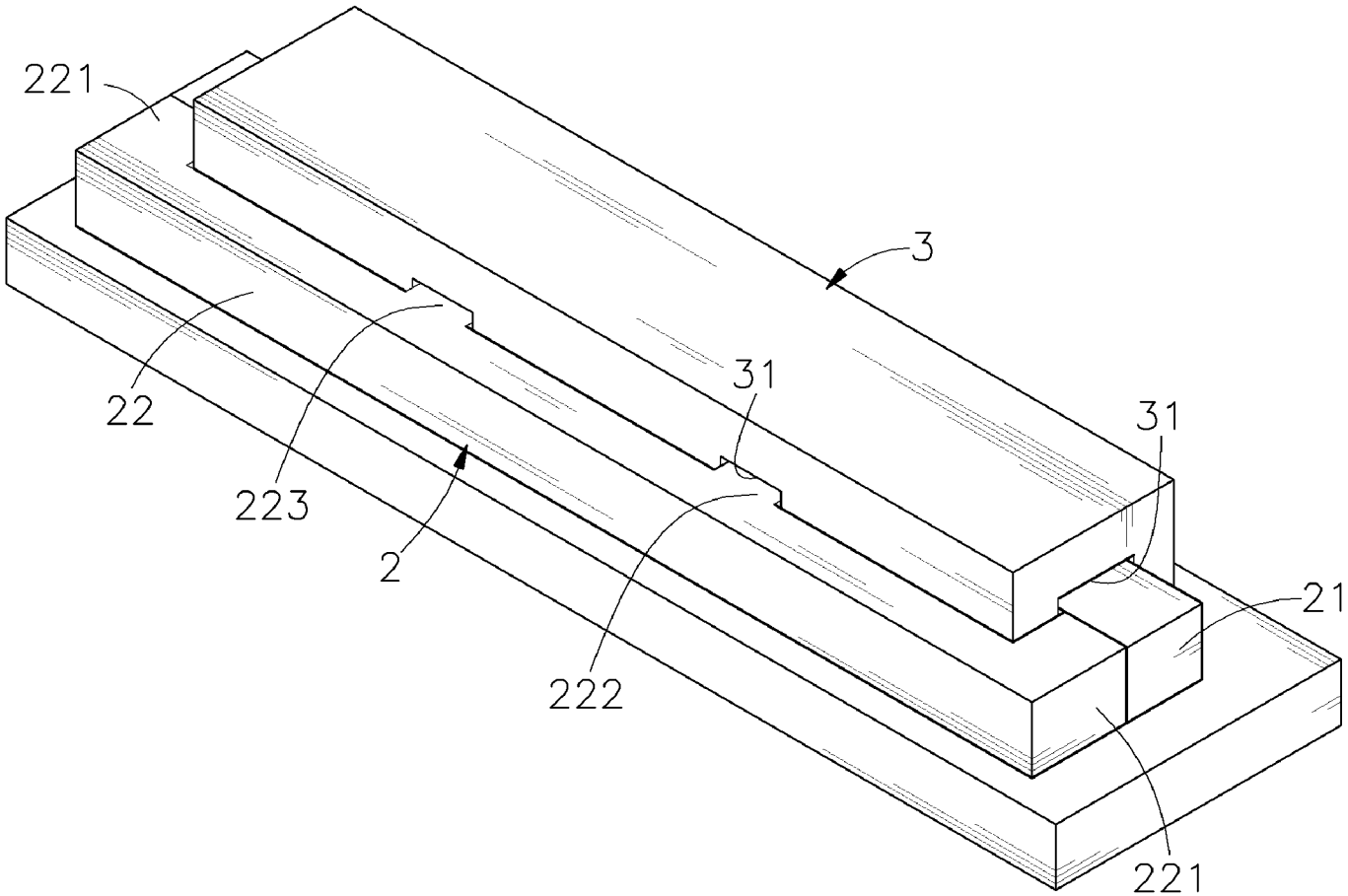
FIG. 6 is a three-dimensional appearance drawing according to another preferred embodiment of the present invention.
Figure 7:
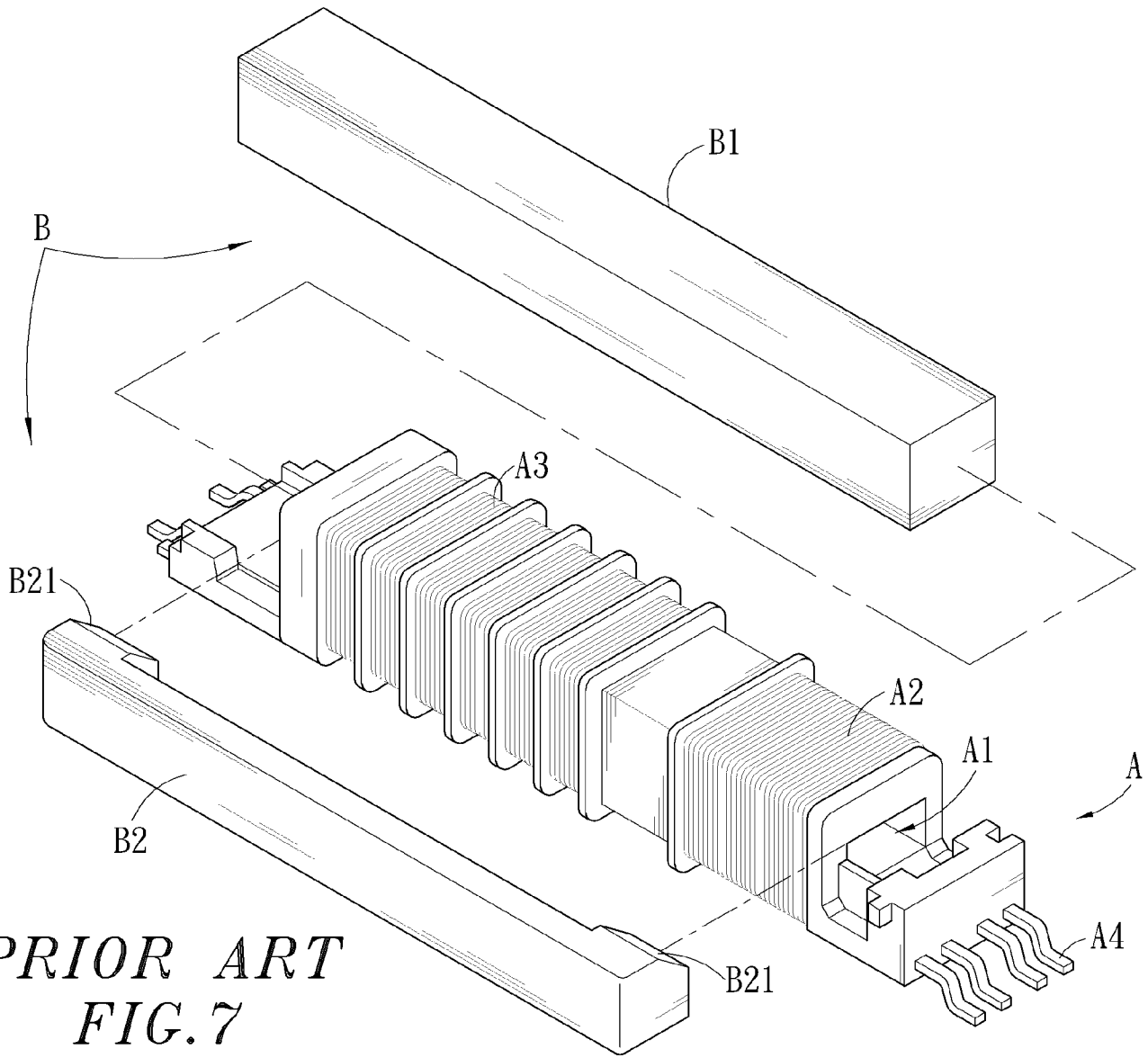
PRIOR ART FIG. 7
FIG. 7 is a breakdown drawing of a high voltage transformer for conventional use.
Figure 8:
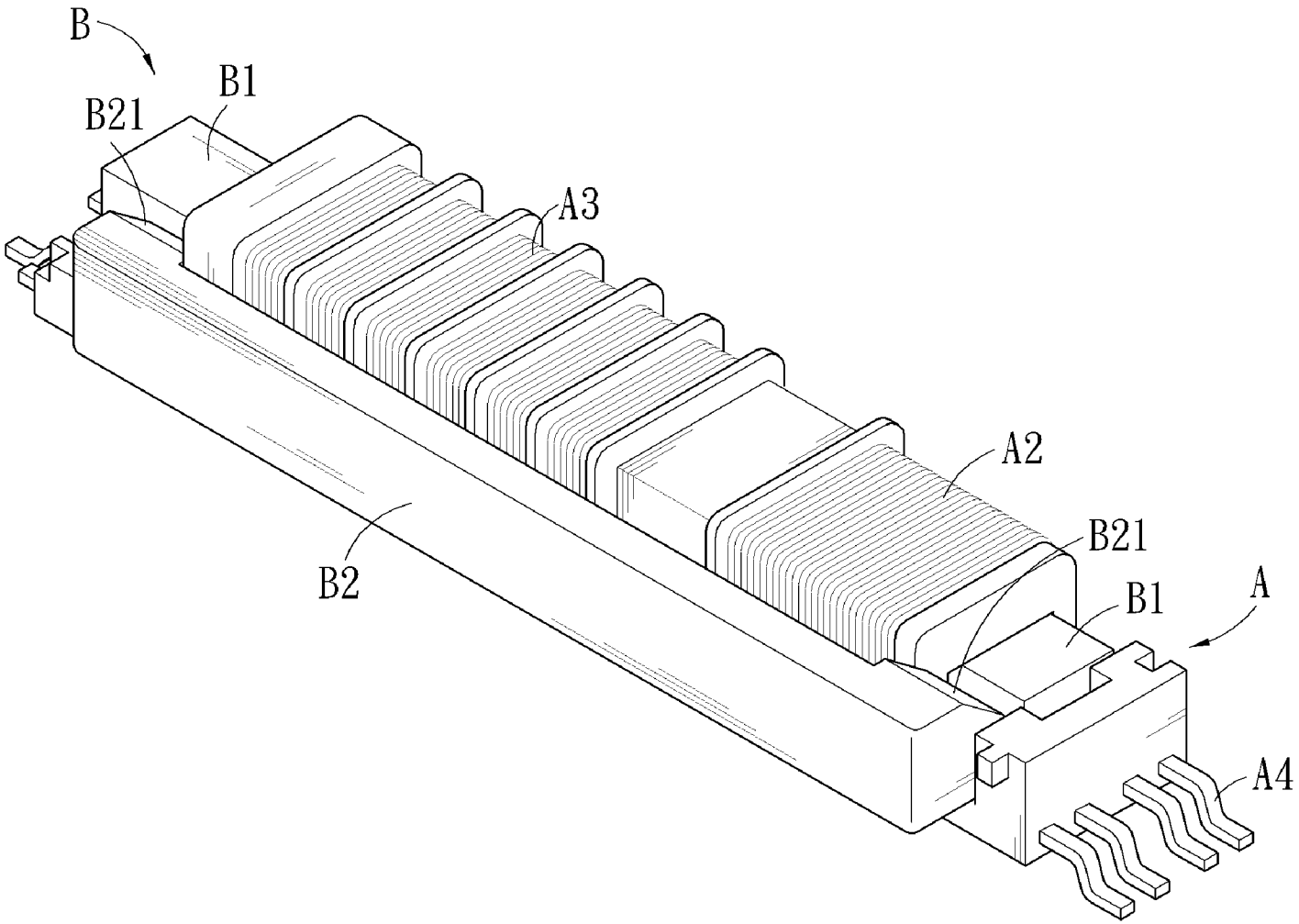
PRIOR ART FIG.8
FIG. 8 shows the three-dimensional appearance of a high voltage transformer for conventional use.

Refer to FIGS. 5 and 6, which are the three dimensional breakdown and appearance drawings respectively according to another preferred embodiment of the present invention. As shown in these figures, the high voltage transformer of the present invention can also be covered by a protection cover 3. For assembly procedures, the protection cover 3 shall cover the hollow support 11 of the base 1 at first, and then the first core 21 of the core set 2 shall pierce through open holes 31 on the protection cover 3 that corresponds to the internal through hole 12. Similarly, the first protrusive part 222 and the second protrusive part 223 of the second core 22 also pierce into the open holes 31 at the side edge of the protection cover 3 and assemble with the first core 21 within the first slot 113 and the second slot 114. Besides, the open holes 31 shall be opened on the protection cover 3 to correspond with the internal through hole 12, the first slot 113 and the second slot 114 for the core set 2 to pierce through. Inside the protection cover 3, a the first isolation plate 32 shall be installed to correspond between the first secondary coil 14 and the first protrusive part 222 of the second core 22, and the second isolation plate 33 shall be installed to correspond between the second secondary coil 15 and the second protrusive part 223 of the second core 22, so that these isolation plates can separate the first protrusive part 222 and the second protrusive part 223 from the first secondary coil 14 and the second secondary coil 15. This can prevent high voltage puncture that may occur due to close proximity of the first protrusive part 222 of the second core 22 to the first secondary coil 14, or of the second protrusive part 223 to the second secondary coil 15 when the high voltage transformer is used. Besides, this can enlarge the creepage distance for coil winding to establish a safe distance and avoid sparking phenomena (short-circuits) that may occur due to unsafe distances from the two protrusive parts 222 and 223 of the second core 22 to the two secondary coils 14 and 15, thus improving the operational efficiency of the transformer and extending its service life. Moreover, because the primary coils 13 wind around the left and right sides of the central isolation plate 111 at the centre of the high voltage transformer, and are connected via winding with the isolation plate 115 that lies between the first and second secondary coils 14 and 15, this can also enlarge the creepage distance for coil winding to form a safe distance, avoiding sparking phenomena (short-circuits) that may occur due to insufficient safe distances from the primary coils 13 to the two secondary coils 14 and 15, thus raising the operational efficiency of the high voltage transformer and extending its service life.

When the above-mentioned transformer is connected with two or more series lamps, no voltage withstanding problem is found to be too difficult to overcome. Due to the creepage distance formed by installing the isolation plate 115 between the primary coils 13 of the transformer and the two secondary coils 14 and 15, the high voltage generated by the series lamp can be overcomed and the voltage withstanding properties of the transformer can be improved, thus the high voltages outputted from the two secondary coils 14 and 15 of the transformer can drive two or more lamps respectively.

Thus, in the present invention, the internal through hole 12 inside the hollow support 11 of the base 1 can be pierced by the first core 21 of the core set 2. The central isolation plate 111 is installed roughly at the center on the surface of the hollow support 11. The primary coils 13 and the two secondary coils 14 and 15 are wound on the left and right sides of the central isolation plate 111 in an orderly way. Then the first slot 113 and the second slot 114 are opened on the hollow support 11 and correspond between the primary coils 13 and the two secondary coils 14 and 15, and are connected to the internal through hole 12. The plurality of isolation plates 115 is installed on both sides of the two secondary coils 14 and 15 to enlarge the creepage distance for coil winding. When the second core 22 of the core set 2 is fixed on one side of the hollow support 11, the two extensions 221 and the two protrusive parts 222 and 223 of the second core are combined with the first core 21 to ensure that the primary coils 13, the two secondary coils 14□15, the first core 21 and the second core 22 can form multiple magnetic paths as bypass circuits to generate magnetic leakage, so as to reduce the coupling effect between the primary coils 13 and the two secondary coils 14□15, enhance the leakage inductance and enlarge the creepage distance for coil winding, and at the same time, ensure that one high voltage transformer can drive more than two lamps by providing dual high voltage output.

Therefore, the high voltage transformer with high magnetic leakage and dual high voltage output of the present invention, when applied, can eliminate the disadvantages that are commonly seen as follows:

(1) The present invention relies on connection of the primary coils 13 with two sets of secondary coils on left and right sides of the first secondary coil 14 and the second secondary coil 15, together with the first core 21 and the second core 22 to form multiple magnetic paths with bypass flux, so as to enhance leakage inductance and meet the requirement of resonance, and to ensure that a high voltage transformer can drive two or more lamps by providing dual high voltage output.

(2) The present invention uses the protection cover 3 which contains the first isolation plate 32 and the second isolation plate 33 to cover the high voltage transformer included in the present invention. This can separate the two secondary coils 14□15 from the two protrusive parts 222□223 of the second core 22 respectively, thus further preventing high voltage puncture from occurring due to close proximity of the two protrusive parts 222□223 of the second core 22 to the two secondary coils 14□15. It can enlarge the creepage distance for coil winding to establish a safe distance and avoid sparking phenomena (short circuits) that may occur due to insufficient safe distances from the two protrusive parts 222□223 of the second core 22 to the two secondary coils 14□15, thus further raising the operational efficiency of the high voltage transformer and its service life.

In summary, the high voltage transformer with high magnetic leakage and dual high voltage output of the present invention, once applied, can really achieve its functions and objectives. Therefore, the present invention is really an excellent one with practical applicability and satisfies the conditions for patentability of a utility model. While the application of patent is filed pursuant to applicable laws, your early approval of the present invention will be highly appreciated so as to guarantee benefits and rights of the inventor who has worked hard at this invention. For any question, please do not hesitate to inform the inventor by mail, and the inventor will try his best to cooperate with you.

What the invention claimed is:

1. A high voltage transformer with high magnetic leakage and dual high voltage output, comprising:

a base, comprising a hollow support with an internal through hole;

a core set, comprising a first core piercing into a through hole and a second core disposed on one side of the hollow support;

a central isolation plate, disposed at a middle region of the hollow support, wherein a primary coil and a plurality of isolation channels for wrapping a first secondary coil are configured in sequence at one side of the central isolation plate, and a primary coil and a plurality of isolation channels for wrapping a second secondary coil configured in sequence at another side of the central isolation plate; and a protection cover, covering the hollow support of the base.

2. The high voltage transformer with high magnetic leakage and dual high voltage output according to claim 1, wherein a first slot is opened on the hollow support between the primary coils and the first secondary coil, and is connected to the internal through hole, a second slot is opened on the hollow support between the primary coils and the second secondary coil, and is connected to the internal through hole, and isolation plates are installed on both sides of the first and second secondary coils to enlarge the creepage distance for coil winding, and an input terminal is installed at one end of the hollow support to connect the primary coils, while an output terminal is placed at the other end far away from the input terminal to connect the first and second secondary coils.

3. The high voltage transformer with high magnetic leakage and dual high voltage output according to claim 1, wherein two ends of the second core extend over two corresponding sides of the first core, and a first protrusive part and a second protrusive part are disposed between the two extensions corresponding to first and second slots disposed within the first core.

4. The high voltage transformer with high magnetic leakage and dual high voltage output according to claim 1, wherein the protection cover comprises multiple holes corresponding to the internal through hole, the first slot and the second slot for the core set to pierce through, and wherein the first isolation plate is disposed between the first secondary coil and the first protrusive part of the second core, and the second isolation plate is disposed between the second secondary coil and the second protrusive part of the second core, respectively.

5. The high voltage transformer with high magnetic leakage and dual high voltage output according to claim 1, wherein the first and second secondary coils at both ends of the base are connected to two output terminals through wires extending from the first and second secondary coils respectively.

6. The high voltage transformer with high magnetic leakage and dual high voltage output according to claim 1, wherein the primary coils on both sides of the isolation plate at the center of the base are interconnected, wound with the isolation plate at the bottom and further connected to input terminals.

* * * * *